United States Patent [19]

Snyder

[11] 4,189,186

[45] Feb. 19, 1980

[54] TUNNELING MACHINE

[75] Inventor: Larry L. Snyder, Richfield, Ohio

[73] Assignee: Jarva, Inc., Solon, Ohio

[21] Appl. No.: 914,743

[22] Filed: Jun. 12, 1978

[51] Int. Cl.[2] ..... E01D 9/10

[52] U.S. Cl. ..... 299/31; 173/150

[58] Field of Search ..... 299/31; 173/150

[56] References Cited

U.S. PATENT DOCUMENTS

| | | | |
|---|---|---|---|
| 1,039,809 | 10/1912 | Rogers | 299/31 |
| 1,219,419 | 3/1917 | App | 299/31 |
| 1,284,398 | 11/1918 | McKinlay | 299/31 |
| 2,925,258 | 2/1960 | Robbins | 299/31 |
| 3,640,573 | 2/1972 | Safar | 299/31 |
| 3,653,716 | 4/1972 | Hattrup | 299/31 |

FOREIGN PATENT DOCUMENTS

| | | | |
|---|---|---|---|
| 124898 | 1/1959 | U.S.S.R. | 299/31 |

*Primary Examiner*—Ernest R. Purser

*Attorney, Agent, or Firm*—Pearne, Gordon, Sessions

[57] ABSTRACT

A diametrically compact tunneling machine for boring tunnels is disclosed. The machine includes a tubular support frame having a hollow piston mounted therein which is movable from a retracted position in the support frame to an extended position. A drive shaft is rotatably mounted in the hollow piston and carries a cutter head at one end. The hollow piston is restrained against rotational movement relative to the support frame and the drive shaft is constrained against longitudinal movement relative to the hollow piston. A plurality of radially extendible feet project from the support frame to the tunnel wall to grip the tunnel wall during a tunneling operation wherein the hollow piston is driven forwardly so that the cutter head works on the tunnel face. When the hollow piston is fully extended, a plurality of extendible support feet, which are fixed to the rearward and forward ends of the hollow piston, are extended, the radially extendible feet are retracted and the support frame is shifted forwardly by the piston so that a further tunneling operation may be initiated.

17 Claims, 5 Drawing Figures

TUNNELING MACHINE

BACKGROUND OF THE INVENTION

This invention relates generally to tunneling machines, and more particularly to tunneling machines having a rotary boring or cutting head for boring passages through hard rock and minerals.

The digging of a tunnel through soft material, such as clay and soft rock or only partially consolidated materials, has long been done by machines having a rotary cutting head having cutters which scrape and dig away at the material, which is then collected and removed rearwardly from the tunnel. However, when such machines are used against harder materials, and particularly very hard igneous and metamorphic rocks, such scraping type cutters cannot be used, and it is necessary to employ percussive-type roller cutters which chip away small fragments from the mass of rock by impact. The use of such cutters has long been known for drilling wells and other relatively small diameter holes, but efforts to adapt such cutters to larger machines for use in drilling tunnels have met with considerable difficulty because of the necessary forces involved and the shock loads encountered.

A reliable and proven machine has been developed for cutting hard rock at a fast enough cutting rate to make it competitive with prior tunneling methods. That machine is set forth in U.S. Pat. No. 3,383,138. According to that patent, a fixed supporting frame is anchored in the tunnel by two axially spaced sets of projecting arms, each set of which has four arms equidistantly spaced and actuated by hydraulic cylinders to position the frame without regard to the weight of the machine. A movable frame is carried centrally within the supporting frame by sets of torque arms at each end, which both support the moving frame and transmit the reaction torque from the moving frame to the supporting frame. A cutter head is mounted in bearings at the front end of the moving frame and carries a cutter plate having a number of roller cutters mounted thereon. A drive shaft extends the length of the moving frame to project beyond the rear of the supporting frame where the shaft is driven by a plurality of motors which drive an encircling ring gear. Hydraulic cylinders acting between the supporting frame and the cutter head apply the force directly to the bearing supporting the cutter head to cause the moving frame to move relative to the supporting frame. After the moving frame is moved through its full range of movement, a jack is lowered at the rear end to support the moving frame by the jack and the cutter head to allow the supporting frame to have the arms retracted and moved forward to the next position, where the supporting frame is again anchored to allow the cutting movement to continue.

Tunneling machines according to the foregoing patent are adapted to bore tunnels having diameters from eight to 30 feet and more. Those machines are not entirely suited for drilling tunnels of diameters smaller than eight feet. Merely scaling down the machine shown in the foregoing patent reduces structural and hydraulic capabilities of the machine. Limiting factors as to the diametrical size of the tunneling machine according to U.S. Pat. No. 3,383,138 are the torque arms, which travel in a radial direction, the radially offset placement of the hydraulic cylinders, which drive the cutter head forwardly, and the radially offset placement of the motors, which are employed to drive the ring gear associated with the cutter head drive shaft.

SUMMARY OF THE INVENTION

This invention provides a tunneling machine which is diametrically compact and which is particularly suited for cutting relatively small diameter tunnels, i.e., tunnels having a diameter of eight feet or less.

The tunneling machine according to this invention includes a support frame having a plurality of extendible feet which are outwardly movable to grip the tunnel wall. The feet fixedly position the support frame in the tunnel in a predetermined alignment. The support frame is provided with an axial bore therethrough and a hollow piston is mounted in the bore for longitudinal movement along the axis of the tunnel. The piston is provided with a piston head which is slidable along the bore so that fluid pressure may be employed to advance and retract the hollow piston. The hollow piston is restrained against rotation relative to the support frame and a drive shaft is rotatably mounted in the hollow piston and is fixed against longitudinal movement with respect to the piston. One end of the drive shaft extends beyond one end of the piston and carries a rotatable cutter head thereon, and the shaft is driven by a single, axially mounted motor at the other end of the drive shaft. A machine is provided with a plurality of extendible support feet fixed to the rearward and forward ends of the hollow piston to support the machine when the extendible feet are out of engagement with the tunnel wall.

A tunneling operation is carried out by extending the extendible feet to securely hold the support frame relative to the tunnel wall, while the hollow piston drives the drive shaft, and therefore the cutter head, against the face of the tunnel. When the drive shaft and cutter head are fully extended, the support feet are extended and the extendible feet are retracted. The support frame is then advanced toward the cutter head by the piston, the extendible feet are advanced to the tunnel wall, and the support feet are retracted.

To further minimize the bulkiness of the tunneling machine, auxiliary servicing equipment and the operator station are located on a trailer which is attached by cables to the support frame, and which is pulled by the support frame when the support frame is advanced.

DETAILED DESCRIPTION OF THE INVENTION

Figure 1:
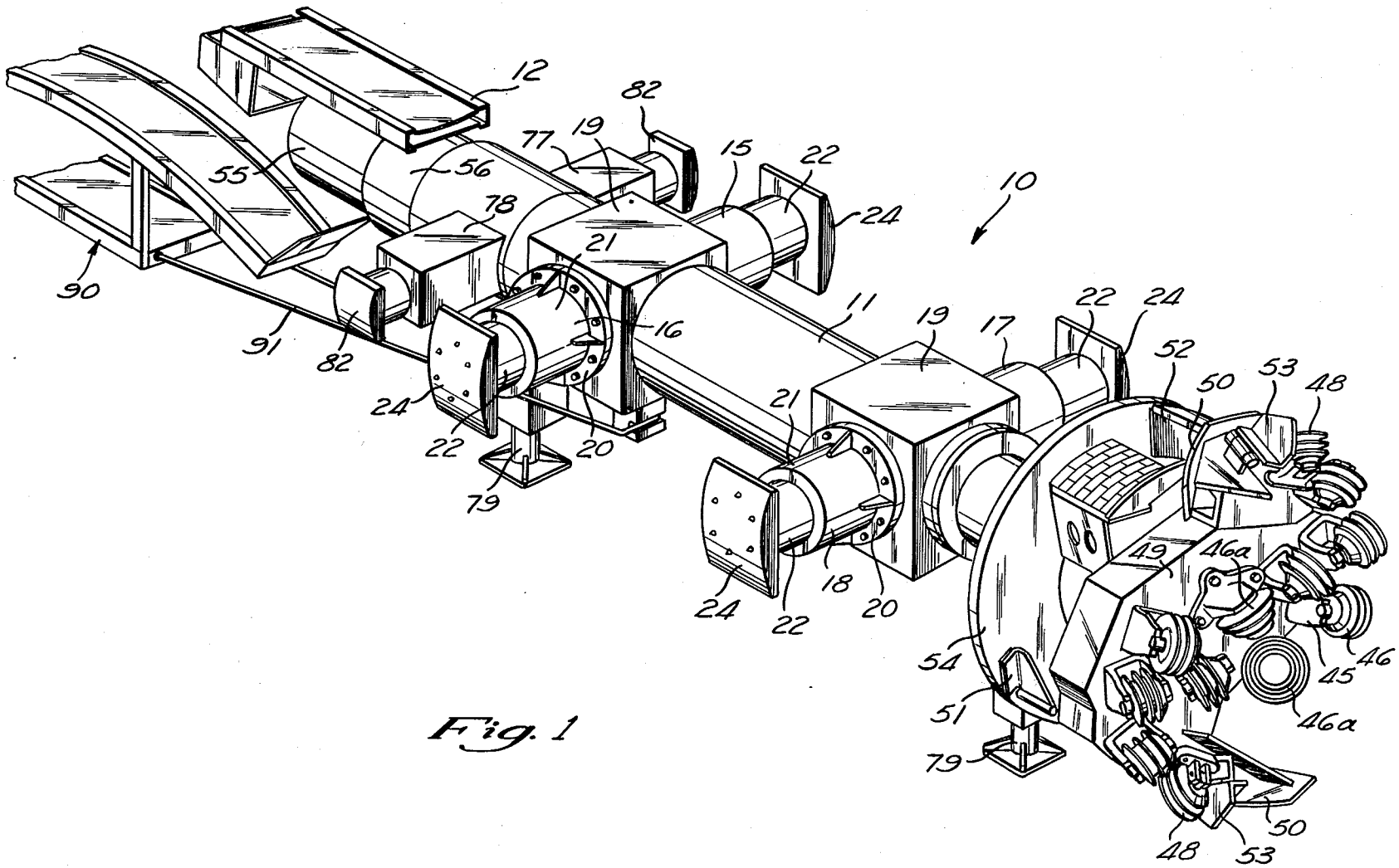
FIG. 1 is a perspective view of the tunneling machine and its trailer.
Figure 2:
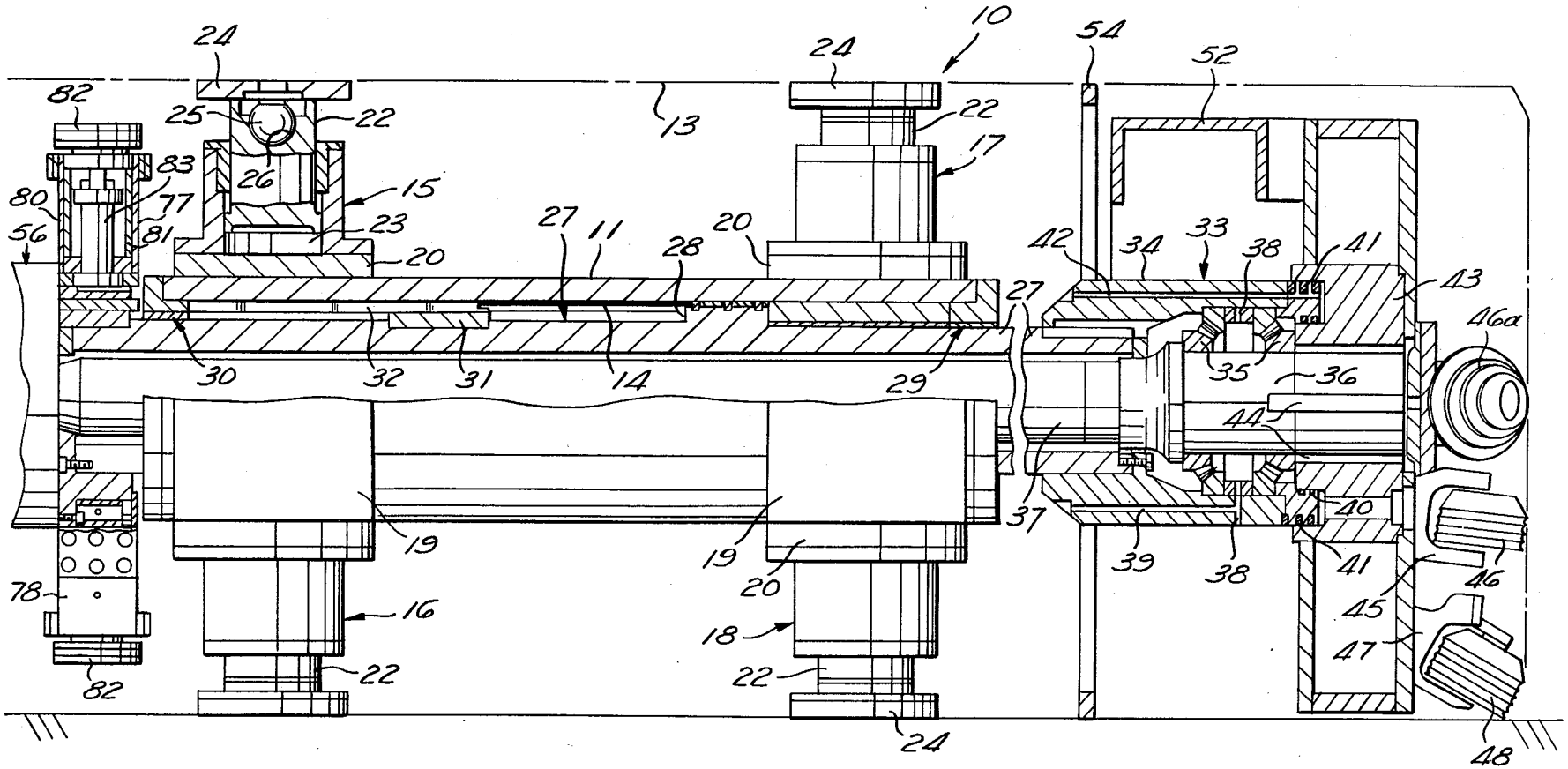
FIG. 2 is a plan view, partly in section, of the tunneling machine illustrated in FIG. 1.

Referring now to the drawings, and particularly to FIGS. 1 and 2, there is illustrated a tunneling machine 10 having a support frame 11 upon which a conveyor 12 is mounted. The support frame 10 is braced against the tunnel walls 13 to position the machine in proper alignment and absorb the torque and thrust forces produced by the cutting action. The support frame 11 is provided with a bore 14 therethrough.

The support frame 11 carries four horizontal, radially extending clamp legs 15, 16, 17, and 18. Each foot 15–18 includes a saddle 19 welded to the support frame and a spacer plate 20 bolted to the saddle. On each spacer plate 20 there is provided a cylinder 21 which is bolted through the spacer plate 20 to the saddle 19. The spacer plates may be removed when drilling smaller diameter tunnels. A large diameter piston 22 is slidably mounted in each cylinder 21 to define a pressure chamber 13 which is pressurized by a suitable source of hydraulic pressure (not shown). Each piston has a pressure pad 24 attached thereto by a ball 25 which is received in a spherical socket 26. The ball and socket connection between the pad 24 and its piston 22 permits movement of the pad relative to the piston to compensate for uneven tunnel wall portions. The foregoing arrangement provides a compact foot and provides an arrangement wherein fluid pressure is applied to a greater area of the pressure pad, as compared to prior art arrangements wherein pressure is applied to the pad by conventional piston and cylinder arrangements. It will be seen that since the only contact between the support frame 11 and the wall is at the four pads 25, the longitudinal axis of the support frame 11 may thus be guided and aligned for steering purposes by adjusting the relative radial extension of the pads by the pistons 22.

Within the bore 14 of the support frame 11 there is provided a hollow piston 27 which extends beyond the front and rear portions of the support frame 11. The hollow piston 27 has an annular piston head 28 adjacent its midportion which divides a space between the bore 14 and the hollow piston 27 into forward and rearward pressure chambers. Those chambers are sealed at their ends by front and rear ring seals 29 and 30, respectively. As is illustrated in FIG. 2, the hollow piston 27 is at the forward end of its stroke and may be retracted by admitting fluid pressure through the pressure chamber between the piston head 28 and the ring seal 29 while exhausting fluid from the space between the piston head 28 and the ring seal 30. The hollow piston 27 is restrained against rotation relative to the support frame 11 by a plurality of keys 31 fixed to the hollow piston 27 and receivable in a corresponding number of keyways 32 fixed to the bore of the support frame 11. Adequate lubrication is provided between the keys 31 and their keyways 32 by fluid in the rear pressure chamber.

The forward end of the hollow piston 27 carries an enlarged cutter head housing 33 having an annular, axially extending outer wall 34 which supports the outer race of a bearing 35. The bearing 35 is preferably of the high capacity, double row tapered roller type adapted to absorb both radial loads and thrust loads in either direction. The split inner race of the bearing 35 is secured to the outer surface of a cutter head hub portion 36 of a drive shaft 37, which extends through the hollow piston 27 to journal the drive shaft for rotation with respect to the hollow piston. The bearing 35 is supplied with lubricant through ports 38 and 39, and the lubricant not only lubricates the bearing but also prevents rock and other foreign matter from penetrating past circumferential seals 40 and 41. To further enhance the seal, lubricant may be fed to a space between the seals 40 and 41 by a passageway 42.

A rotatable cutter head 43 is fixed to the forward end of the drive shaft 37 by a plurality of keys 44. A plurality of inside saddles 45 are located in predetermined positions on the forward end face of the cutter head 43 by locating dowel pins (not shown) and are welded to the cutter head 43. Each inside saddle 45 carries an inside roller cutter 46. In a similar manner, two gage saddles 47 are located in predetermined positions on the front face of the cutter head 43 by locating dowel pins (not shown) and suitably welded to the cutter head. A gage roller cutter 48 is rotatably journaled in a suitable manner to each of the gage saddles 47. The gage saddles 47 support the gage cutters 48 in such a manner that the axis of rotation of the gage cutters 48 is at an angle to the axis of rotation of the inside cutters 46, so that the tunnel end face is provided with a slightly relieved portion adjacent the cylindrical tunnel wall. A pair of center cutters **46*a*** are also provided.

The inside cutters 46, the gage cutters 48, and the center cutters may be of any desired type, and are chosen in a well known manner. For example, when tooth-type cutters are to be used and soft formations such as clay and soft shale are expected to be encountered, the cutters must have teeth large enough to produce a gouging action in the formation. Tooth-type cutters for medium-hard formations, such as limestone and sandstone, must have a larger number of slightly smaller teeth to prevent breakage. For extremely hard, igneous formations, such as granite, quartzite, or basalt, tooth-type cutters having individually mounted tungsten carbide inserts in the cutting face may be used. If desired, a circumferential tooth kerf-type cutter may be used for a wide range of soft to medium-hard formations.

Figure 4:
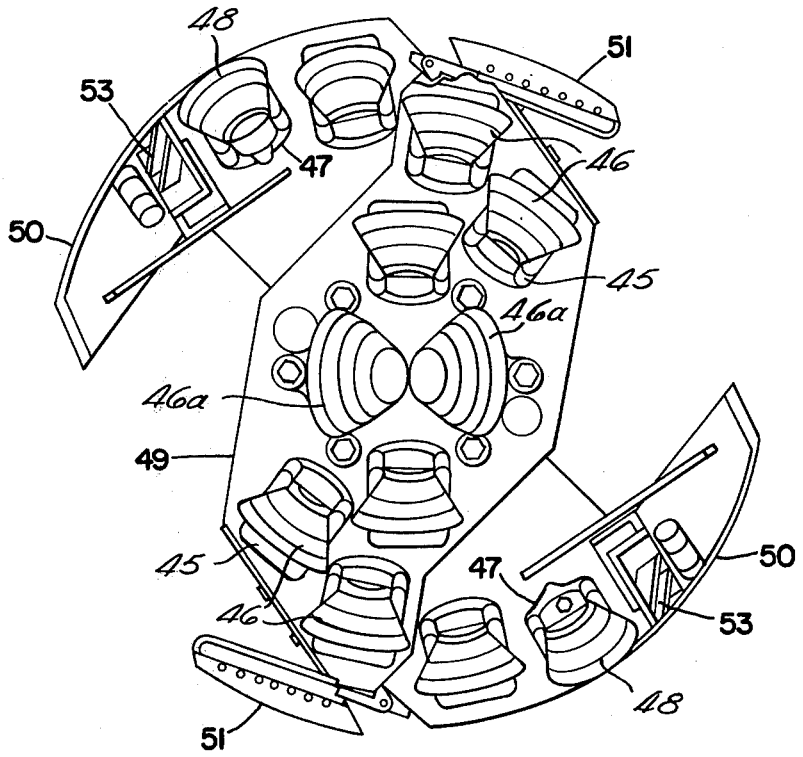
FIG. 4 is a front elevational view of the cutter wheel assembly.
Figure 5:
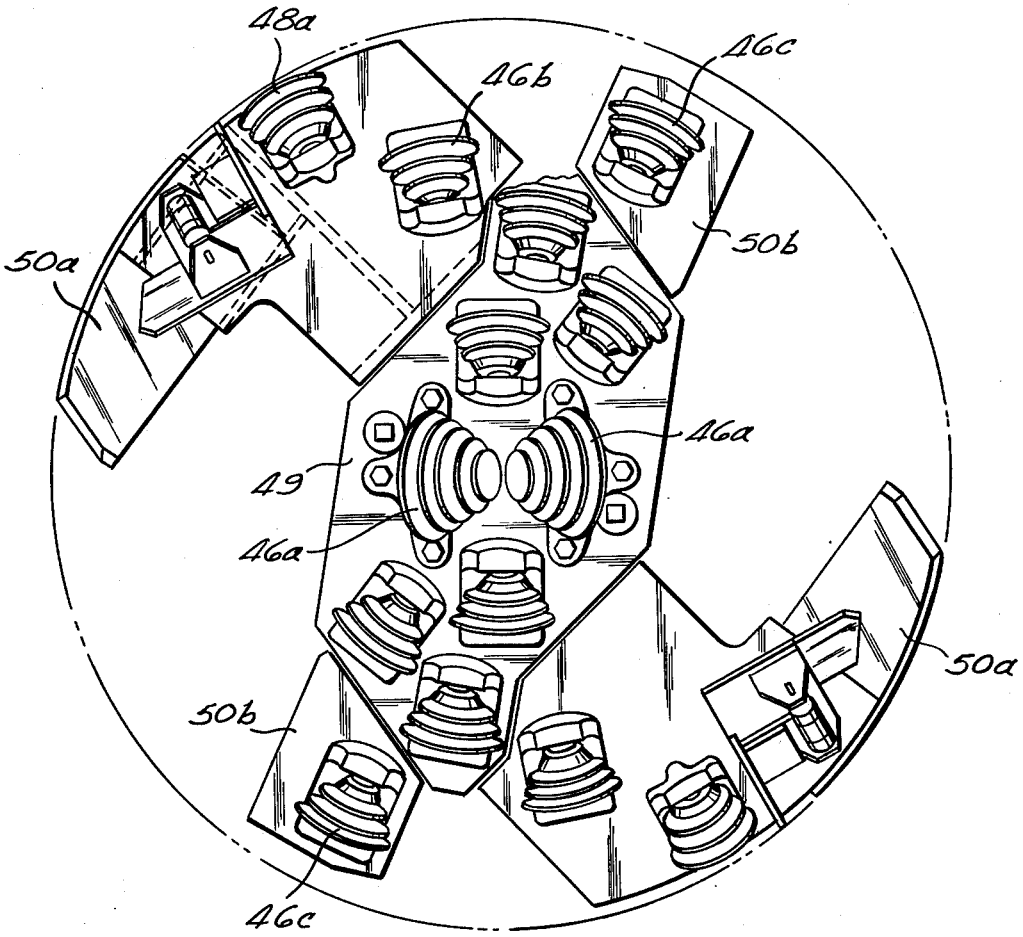
FIG. 5 is a front elevational view of a cutter wheel assembly according to another aspect of this invention.

Referring now to FIG. 4, the cutter head includes a diametrically extending, elongated center section 49 and a pair of arcuately extending, removable and replaceable gage spokes 50 which extend in opposite directions from the extremities of the center section 49. Thus, the diameter of the tunnel may be varied by replacing the gage spokes 50 with other spokes having greater axial extents and greater numbers of inside cutters thereon. Such other spokes are shown in FIG. 5. In that figure, there is illustrated the diametrically extending, elongated center section 49 provided with a pair of arcuately extending, removable and replaceable gage spokes **50*a*. Each spoke 50*a* carries a gage roller cutter 48*a* and an inside roller cutter 46*b*. Since the cutters 48*a* and 46*b* have a greater radial spacing than the cutters 46 and 48, trailing cutters 46*c* are provided. Each cutter 46*c* is mounted on a trailing spoke 50*b*** removably mounted on the head.

When the hydraulically actuated clamp legs 15–18 are extended radially outwardly to grip the cylindrical wall of the tunnel and prevent movement of the support frame 11 relative thereto, the drive shaft 36 is driven to rotate the cutter head in a clockwise direction as viewed from the rearward portion of the tunneling machine facing forwardly, as will be described. As the cutter head rotates, the rear pressure chamber behind the piston 28 is pressurized to advance the hollow piston 27 and the drive shaft 37 forwardly to force the roller cutters 46 and 48 against the tunnel end face with rolling contact to cut or crush the formation being encountered. Tip and bore scrapers on the paddles are supplied to remove the formation particles that have been cut or crushed from the tunnel end face. This prevents the formation particles from being recut by the roller cutters, and prevents the formation of particles from accumulating between the saddles and the cutters to reduce the possibility of clogging the cutters and to reduce the possibility of any of the cutters ceasing to rotate and being worn by skidding around the tunnel end face. As the cuttings accumulate in the bottom of the tunnel bore, plows 51 deflect this accumulation of formation particles into muck buckets 52 as the cutter head rotates. As the bucket 52 rotates from the lower portion of the tunnel and reaches the upper portion of the tunnel, the contents of the bucket are dropped onto the conveyor 12 to convey the material to the rear of the machine.

As is more fully set forth in U.S. Pat. No. 3,674,314, each gage cutter 48 is provided with a scraper assembly or gage scraper 53, which is mounted so that it immediately precedes its associated gage cutter 48 as the gage cutter travels about the end face of the tunnel.

To confine the dust to the area of the machine adjacent the cutter head, a dust shield 54 is provided.

Figure 3:
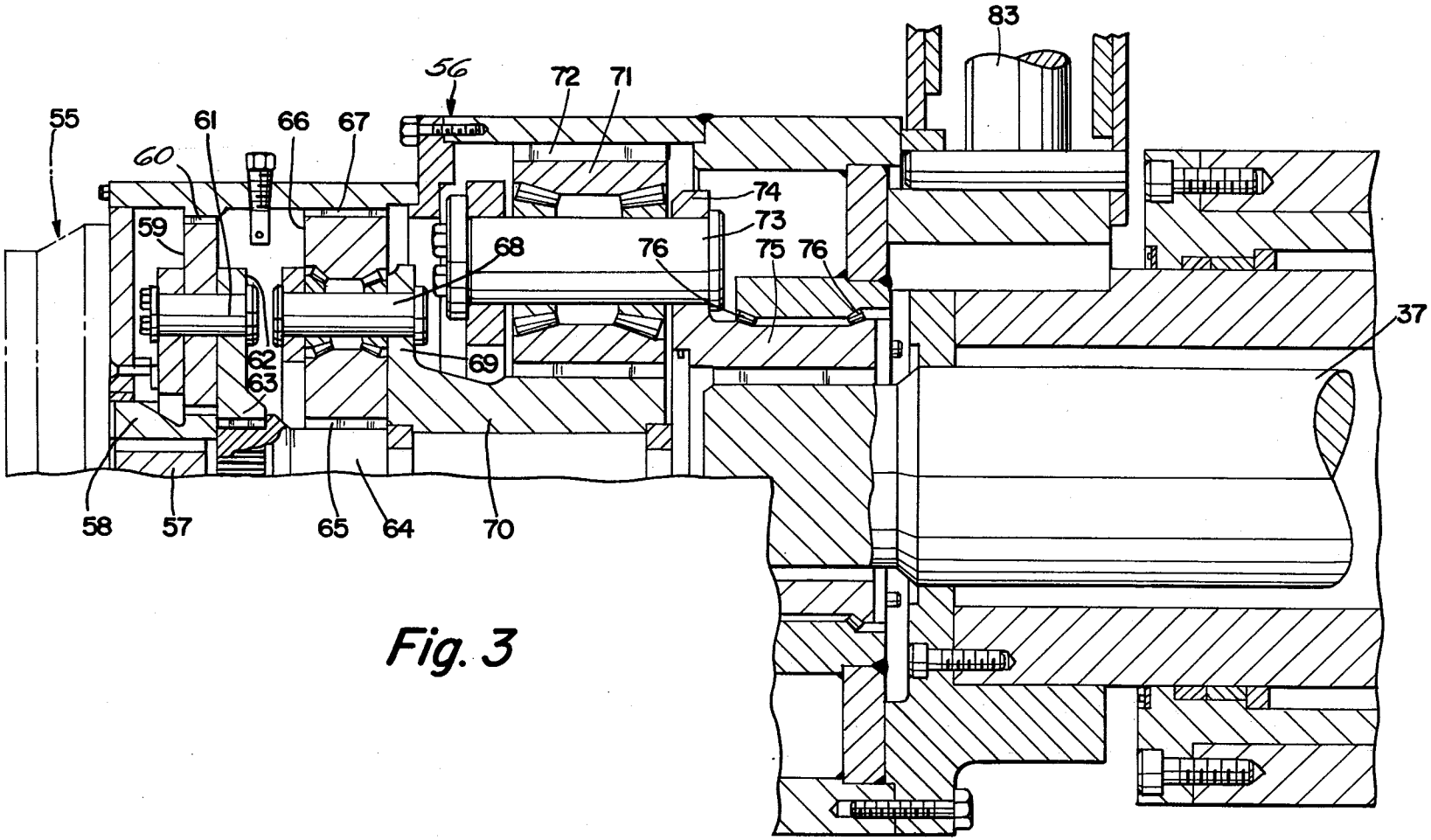
FIG. 3 is a fragmentary, sectional view of the gear reducer drive system for the main drive shaft of the machine.

The drive shaft 37 is rotated by a motor 55 through a three-stage, planetary reducer 56. As may be seen in FIG. 3, the motor 55 has an output shaft 57 connected to a first sun gear 58. The sun gear 58 drives a plurality of first planet gears 59 about a first ring gear 60. Each planet gear 59 has a hub 61 fixed to a first ring gear 60. Each planet gear 59 has a hub 61 fixed to a spoke 62 of a ring 63. The ring 63 is splined to a stub shaft 64. Another portion of the stub shaft 64 carries a second sun gear 65, which drives a plurality of second planet gears 66 about a second ring gear 67. Each planet gear 66 is mounted on a hub 68 and each hub 68 is fixed to a spoke 69 of a sun gear 70. The sun gear 70 drives a plurality of third planet gears 71 about a third ring gear 72. Each sun gear 71 is mounted on a hub 73 and each hub 73 is fixed to a spoke 74 of an annular driving member 75. The annular driving member 75 is splined to one end of the drive shaft 37 and is mounted for rotation by bearings 76.

In the illustrated embodiment of the invention, the motor is a 200 horsepower motor developing 1800 rpm. The three-stage, planetary reducer 56 provides a gear reduction of 144:1 so that the drive shaft 37 may be rotated 12.5 rpm.

As was previously indicated, the tunneling machine 10 is illustrated in its fully extended condition, with the hollow piston 27 at the end of its cutting stroke. To perform a further cutting operation, the support frame 11 is supported by two horizontal, radially extendible feet 77 and 78 and two vertical, radially extendible feet 79. Each foot 77–79 includes an outer box 80 having an inner box 81 telescoped therein. The inner box 81 is provided with a pressure pad 82 at its end, and may be driven radially outwardly by a piston 83 within the box. With the support feet in place against the tunnel walls, the legs 15–18 are retracted. The pressure chamber ahead of the piston head 28 is then pressurized to move the support frame 11 forwardly toward the cutter head. When the support frame 11 reaches the end of its stroke relative to the hollow piston 27, the extendible feet 15–18 are advanced against the tunnel wall and the support feet 77–79 are retracted, and a cutting operation is then initiated.

To further reduce the bulkiness of the machine, auxiliary servicing equipment and the operator station are located on a skid-mounted trailer 90 which is attached by cables 91 to the support frame and which is pulled by the support frame when the support frame is advanced.

While the invention has been described in connection with specific embodiments thereof, it is to be clearly understood that this is done only by way of example, and not as a limitation to the scope of the invention as set forth in the objects thereof and in the appended claims.

What is claimed is:

1. A tunneling machine comprising a support frame, holding means on said support frame outwardly movable to grip a tunnel wall to fixedly position said support frame in the tunnel in a predetermined alignment, said support frame having a bore therethrough, a hollow piston mounted in said bore for longitudinal movement along the axis of the tunnel and having means defining a piston head slidable along said bore, said piston and bore defining fluid pressure chambers to advance and retract said piston, means coacting between said support frame and said hollow piston to prevent rotation of said hollow piston with respect to said support frame, drive shaft means rotatably mounted in said hollow piston and being fixed against longitudinal movement with respect to said piston, one end of said drive shaft means extending beyond one end of said support frame and driving a rotatable cutter head, and rotatable driving means on the other end of said drive shaft means, said drive shaft means being longitudinally fixed with respect to said driving means so that as said piston is advanced and retracted the hollow piston, the drive shaft means and the driving means travel as a unit.

2. A tunneling machine as set forth in claim 1, wherein said holding means comprise a plurality of radially extendible feet extending horizontally from said support frame.

3. A tunneling machine as set forth in claim 2, wherein said holding means comprise two front feet and two rear feet and wherein each foot is a cylinder having an expansible piston therein.

4. A tunneling machine as set forth in claim 1, wherein said rotatable driving means includes a motor mounted at one end of said piston.

5. A tunneling machine as set forth in claim 4, wherein said motor has a power output shaft in axial alignment with said drive shaft.

6. A tunneling machine as set forth in claim 5, wherein said rotatable driving means further includes a gear reducer between said power output shaft and said drive shaft.

7. A tunneling machine as set forth in claim 6, wherein said gear reducer has three stages.

8. A tunneling machine according to claim 1, including a plurality of extendible support feet fixed to the rearward and forward ends of said hollow piston to support the machine when said holding means are out of engagement with the tunnel wall.

9. A tunneling machine as set forth in claim 8, wherein one vertical and two horizontal support feet are provided at the rearward end of the hollow piston and one vertical support foot is provided at the forward end of the hollow piston.

10. A tunneling machine as set forth in claim 1, wherein said rotatable cutter head comprises a diametrically extending, elongated center section and a pair of arcuately extending, removable and replaceable gage spokes extending in opposite directions from the extremities of said center section.

11. A tunneling machine comprising a tubular support frame, a plurality of radially extendible feet extending horizontally from said support frame to grip a tunnel wall to fixedly position said support frame in the tunnel in a predetermined alignment, said support frame having a bore therethrough, a hollow piston mounted in said bore for longitudinal movement along the axis of the tunnel and having means defining a piston head slidably along said bore, said piston and bore defining fluid pressure chambers to advance and retract said piston, means coacting between said support frame and said hollow piston to prevent rotation of said hollow piston with respect to said support frame, drive shaft means rotatably mounted in said hollow piston and being fixed against longitudinal movement with respect to said piston, one end of said drive shaft means extending beyond one end of said support frame and driving a rotatable cutter head, and rotatable driving means on the other end of said drive shaft means, said drive shaft means being longitudinally fixed with respect to said driving means so that, as said piston advances and retracts, the hollow piston, the drive shaft means and the driving means travel as a unit.

12. A tunneling machine as set forth in claim 11, wherein said radially extendible feet comprise two front feet and two rear feet, and wherein each foot is a cylinder having an extensible piston therein.

13. A tunneling machine as set forth in claim 11, wherein said rotatable driving means includes a motor mounted at one end of said piston.

14. A tunneling machine as set forth in claim 13, wherein said motor has a power output shaft in axial alignment with said drive shaft.

15. A tunneling machine as set forth in claim 14, wherein said rotatable driving means further includes a gear reducer between said power output shaft and said drive shaft.

16. A tunneling machine as set forth in claim 15, wherein said gear reducer has three stages.

17. A tunneling machine according to claim 11, including a plurality of extendible support feet fixed to the rearward and forward ends of said hollow piston to support the machine when said holding means are out of engagement with the tunnel wall.

* * * * *